US009613746B2

(12) United States Patent
Miyauchi et al.

(10) Patent No.: US 9,613,746 B2
(45) Date of Patent: Apr. 4, 2017

(54) REACTOR

(71) Applicant: TOYOTA JIDOSHA KABUSHIKI KAISHA, Toyota-shi, Aichi-ken (JP)

(72) Inventors: Hiroyuki Miyauchi, Toyota (JP); Hirotaka Kamijo, Aichi-ken (JP); Futoshi Kashiwagi, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/001,954

(22) Filed: Jan. 20, 2016

(65) Prior Publication Data

US 2016/0217899 A1 Jul. 28, 2016

(30) Foreign Application Priority Data

Jan. 26, 2015 (JP) ..... 2015-012183

(51) Int. Cl.

*H01F 27/08* (2006.01)
*H01F 27/30* (2006.01)
*H01F 37/00* (2006.01)
*H01F 27/22* (2006.01)

(52) U.S. Cl.

CPC ..... *H01F 37/00* (2013.01); *H01F 27/22* (2013.01)

(58) Field of Classification Search

CPC ..... H01F 27/28; H01F 27/2823; H01F 27/20; H01F 27/10; H01F 27/325; H01F 27/2847; H01F 27/23; H01F 37/00
USPC ..... 336/61, 65, 67, 205
See application file for complete search history.

(56) References Cited

U.S. PATENT DOCUMENTS

2013/0293335 A1* 11/2013 Yoshikawa ..... H01F 27/02 336/192
2014/0140111 A1* 5/2014 Inaba ..... H01F 37/00 363/37
2014/0218158 A1* 8/2014 Miyamoto ..... H01F 37/00 336/198

FOREIGN PATENT DOCUMENTS

JP 2014-154757 A 8/2014

* cited by examiner

*Primary Examiner* — Mangtin Lian
(74) *Attorney, Agent, or Firm* — Sughrue Mion, PLLC

(57) ABSTRACT

A reactor includes a heat dissipation sheet and a main body. The main body includes a first coil, a second coil, a resin cover and a pressing frame. The resin cover has a central section that covers side surfaces of the first and second coil between the first and second coil. The pressing frame extends along outer peripheries of bottom surfaces of the first coil and the second coil. The pressing frame is configured to press the heat dissipation sheet toward the cooler. The pressing frame has a coupled section that is coupled to a lower surface of the central section. The pressing frame is able to be displaced in a vertical direction with respect to the resin cover other than the central section.

4 Claims, 5 Drawing Sheets

REACTOR

INCORPORATION BY REFERENCE

The disclosure of Japanese Patent Application No. 2015-012183 filed on Jan. 26, 2015 including the specification, drawings and abstract is incorporated herein by reference in its entirety.

BACKGROUND OF THE INVENTION

1. Field of the Invention

This specification discloses a reactor in which a reactor main body is pressed against a cooler via a heat dissipation sheet.

2. Description of Related Art

In Japanese Patent Application Publication No. 2014-154757 (JP 2014-154757 A), a reactor in which a bottom surface of a reactor main body is pressed against a cooler via a heat dissipation sheet is disclosed, the reactor main body having a core, around which a coil is wound. Except for the vicinity of the bottom surface, the reactor main body is covered with a resin cover, and a bottom surface of the coil is projected from the resin cover. By fixing the resin cover to the cooler, the coil and the resin cover are fixed in a state of being tightly adhered to the heat dissipation sheet without clearance.

The heat dissipation sheet is flexible. Thus, a reactive force is generated from the heat dissipation sheet to the coil and the resin cover by pressing the coil and the resin cover against the heat dissipation sheet. The coil and the resin cover are tightly adhered to a wide range of the heat dissipation sheet and crushing the heat dissipation sheet. Thus, the reactive force that is applied to the coil and the resin cover from the heat dissipation sheet is large. In order to attach the reactor main body to the cooler, a distance between the resin cover and the cooler needs to be reduced against a large reactive force, resulting in hard work.

SUMMARY OF THE INVENTION

This specification provides a technique of facilitating work for attaching a reactor main body to a cooler.

A reactor related to the present invention is cooled by a cooler. The reactor includes a heat dissipation sheet and a main body. The main body includes a first coil, second coil, a resin cover and a pressing frame. The first coil and the second coil are arranged in parallel to each other. A first bottom surface as a bottom surface of the first coil and a second bottom surface as a bottom surface of the second coil are aligned in a same plane. The first bottom surface and the second bottom surface are configured to be pressed against an upper surface of the cooler via the heat dissipation sheet. The resin cover covers side surfaces and upper surfaces of the first coil and the second coil other than vicinity of the first bottom surface and the second bottom surface. The resin cover has a central section that covers the side surfaces of the first coil and the second coil between the first coil and the second coil. The pressing frame extends along outer peripheries of the first bottom surface and the second bottom surface. The pressing frame is configured to press the heat dissipation sheet toward the cooler. The pressing frame has a coupled section. The coupled section is coupled to a lower surface of the central section. The pressing frame is able to be displaced in a vertical direction with respect to the resin cover other than the central section.

The pressing frame that is separately located from the central section may be not in contact with the resin cover.

The first bottom surface and the second bottom surface may be in contact with the heat dissipation sheet.

The pressing frame may have such a shape that a first square for surrounding a first opening and a second square for surrounding a second opening share one side with each other, the coupled section is arranged on a shared one side of the pressing frame.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Characteristics of an example, which will be described below, will first be described. (Characteristic 1) Lower surfaces of paired coils are in contact with a heat dissipation sheet. (Characteristic 2) Each of the coils is covered with a resin cover except for the lower surface and the vicinity thereof. (Characteristic 3) A central section of a pressing frame is fixed to a central section of the resin cover, and portions other than the central section of the pressing frame are not fixed to the resin cover. (Characteristic 4) The portions other than the central section of the pressing frame can be displaced in a vertical direction with respect to the resin cover. (Characteristic 5) The portions other than the central section of the pressing frame are not in contact with the resin cover. (Characteristic 6) The heat dissipation sheet has an insulation property. (Characteristic 7) The heat dissipation sheet is made of a silicon resin and is flexible.

A reactor of a first example is used for a converter that converts a voltage of a battery in a vehicle that runs by a motor. Because a large current flows through the reactor, a coil is formed by a rectangular wire with low internal resistance. Because a heat generation amount of the reactor is large, a heat dissipation plate is provided.

Figure 1:
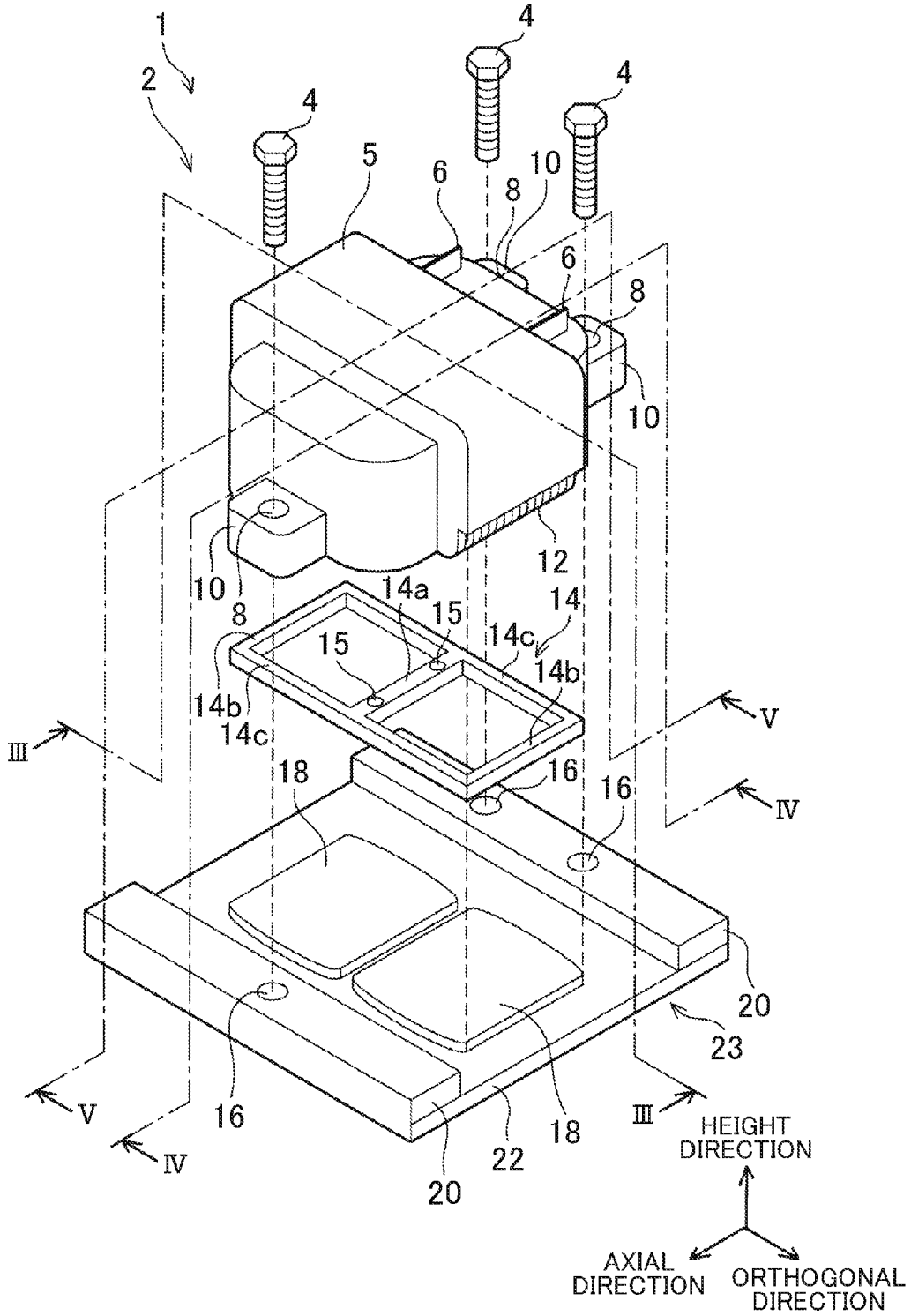
FIG. 1 is an exploded perspective view of a reactor of a first example.
Figure 3:
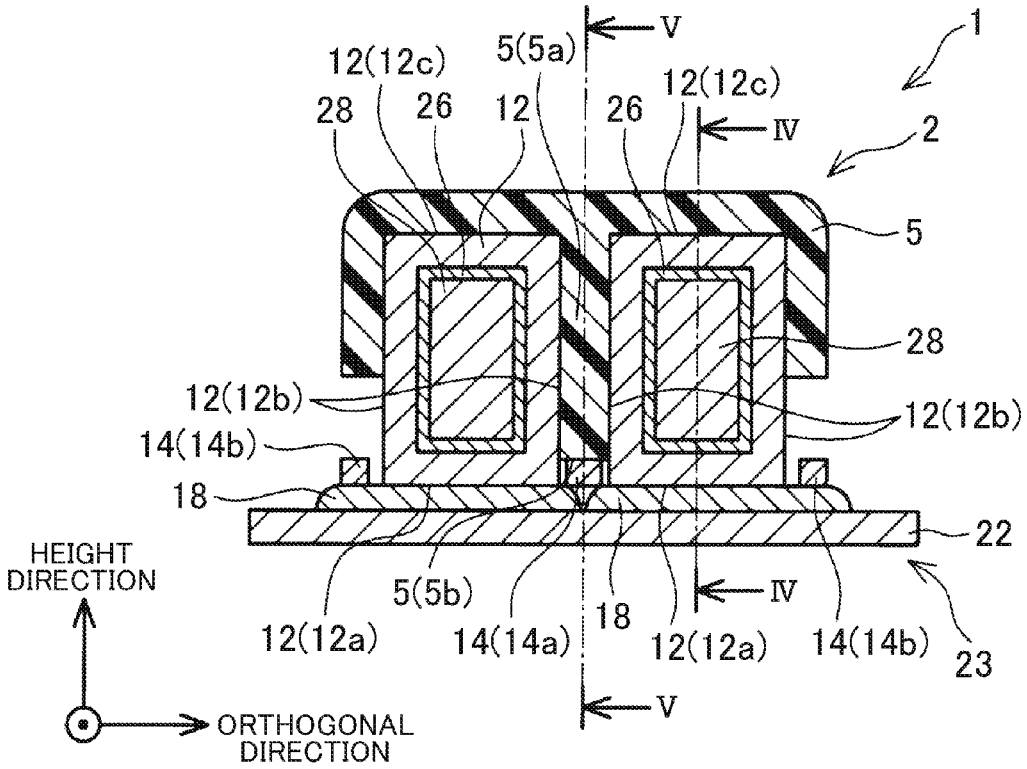
FIG. 3 is a cross-sectional view that is cut along line III-III in FIG. 1 of the reactor in FIG. 1.
Figure 4:
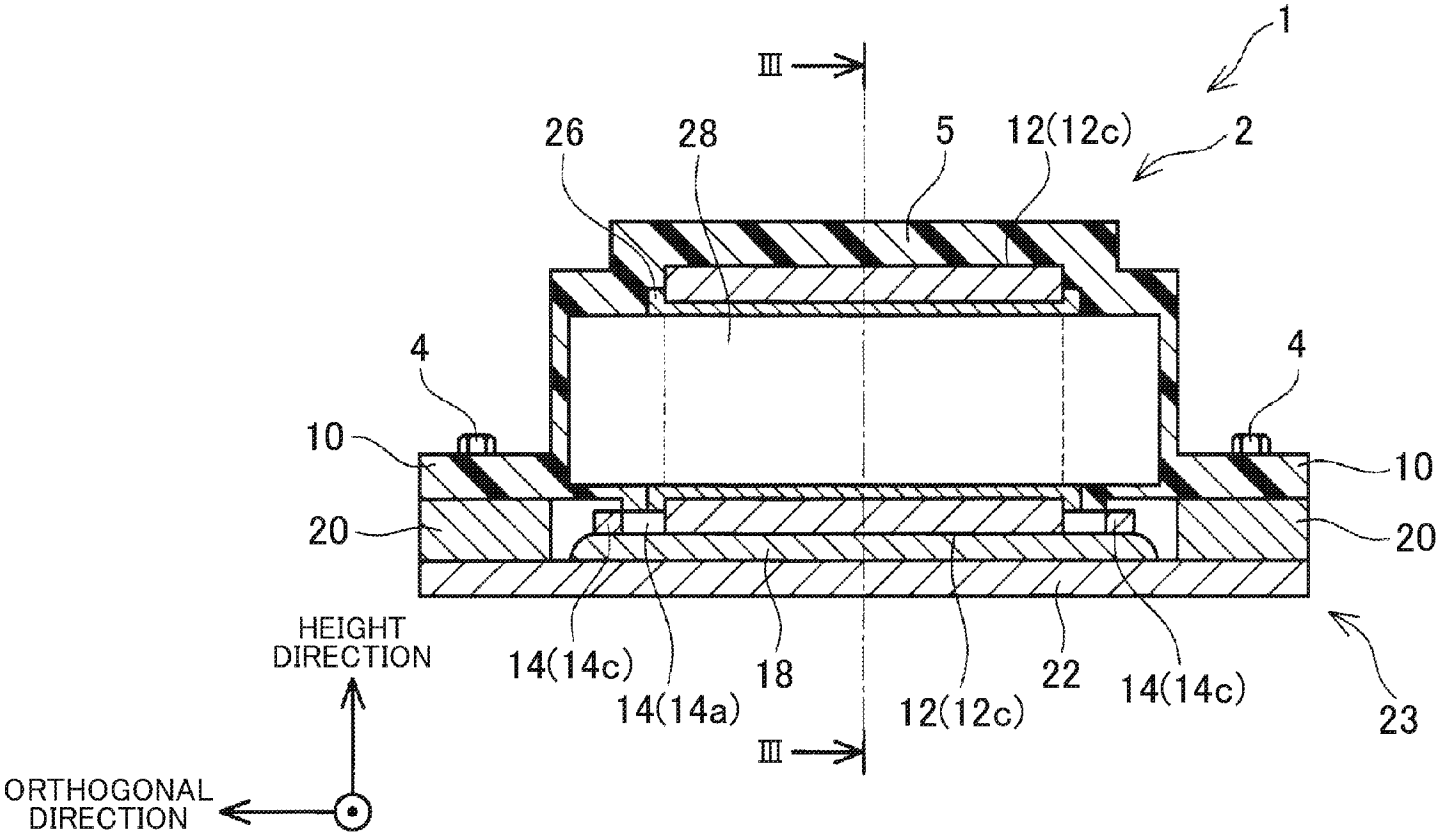
FIG. 4 is a cross-sectional view that is cut along line IV-IV in FIG. 1 of the reactor in FIG. 1.
Figure 5:
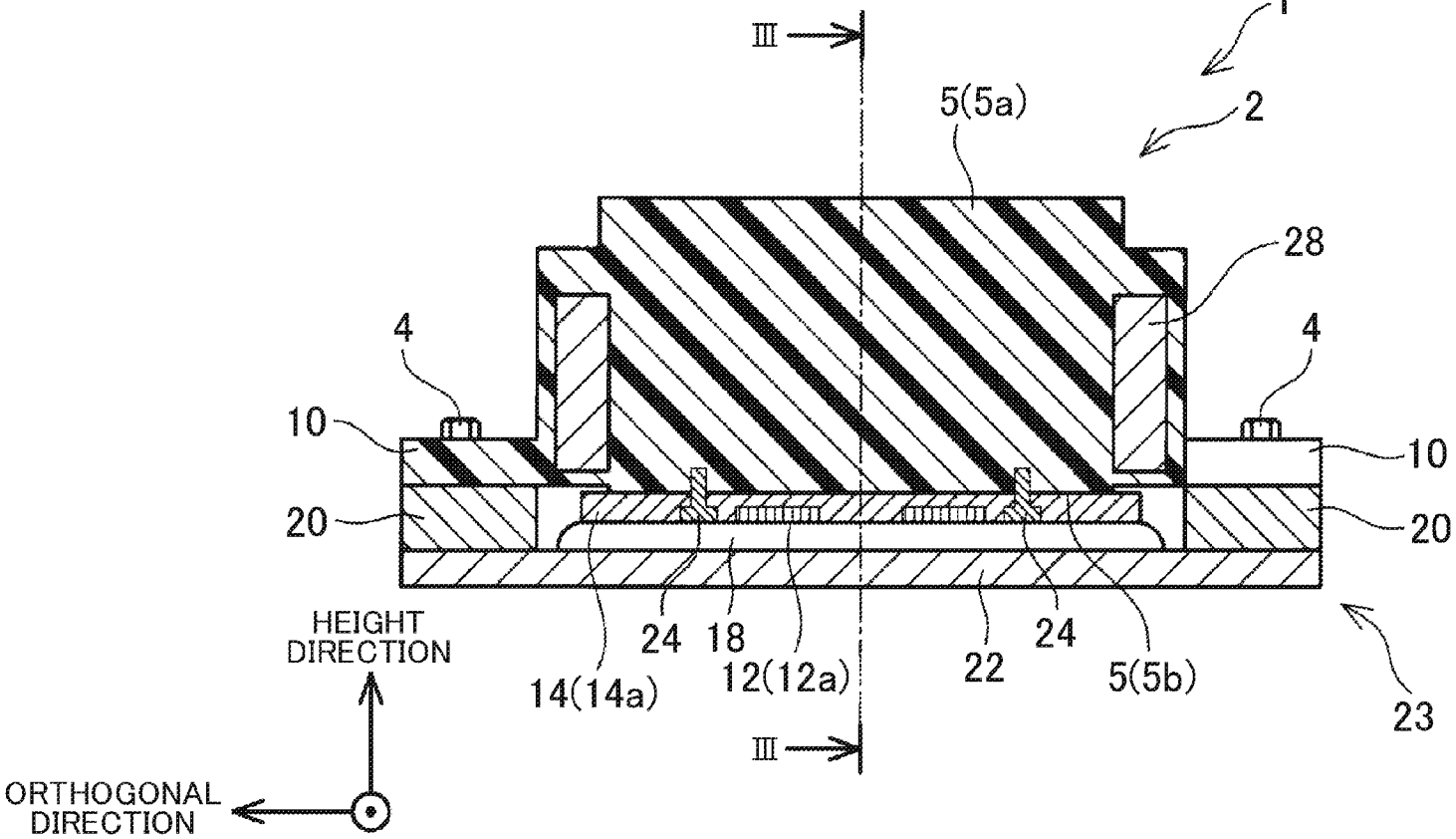
FIG. 5 is a cross-sectional view that is cut along line V-V in FIG. 1 of the reactor in FIG. 1.

FIG. 1 is an exploded perspective view of a reactor 1. The reactor 1 includes a reactor main body 2. The reactor main body 2 includes: a core 28 (see FIGS. 3, 4) that is in a shape of a track in an athletic field when seen in the vertical direction; a bobbin 26 that covers a periphery of the core 28; a coil 12 that is wound around the bobbin 26; and a resin cover 5 that covers the core 28, the bobbin 26, and the coil 12. FIG. 3 shows the paired coils 12 that are respectively wound around the bobbins 26. The paired coils 12 are connected in series and substantially constitute the single coil. Reference numeral 6 in FIG. 1 indicates paired lead ends of the paired coils 12. As shown in FIG. 1, the paired coils 12 are arranged in parallel on two heat dissipation sheets 18. A bottom surface 12*a* of each of the coils 12 that respectively come in contact with the two heat dissipation sheets 18 is aligned in the same plane. Hereinafter, a vertical direction in FIG. 1 is referred to as a height direction, and a direction that is orthogonal to the height direction and an axial direction of each coil 12 is referred to as an orthogonal direction. The bottom surface 12*a* of each coil 12 is in contact with a heat dissipation plate 23 with the heat dissipation sheet 18 being interposed therebetween. A lower surface of the heat dissipation plate 23 is exposed to a heat dissipation medium of gas (air, for example) or a liquid (a coolant, for example). As shown in FIGS. 3 to 5, the resin cover 5 covers a side surface 12*b* and an upper surface 12*c* of each coil 12 in portions of each coil 12 other than that in the vicinity of the bottom surface 12*a*. In addition, a central section 5*a* that covers the side surface 12*b* of each coil 12 between the paired coils 12 is formed in the resin cover 5. The heat dissipation plate 23 is an example of the cooler.

As shown in FIG. 1, three attachment sections 10 are formed in the resin cover 5. Each attachment section 10 has a hole 8.

As shown in FIG. 1, the heat dissipation plate 23 includes a bottom plate 22 and two side plates 20. The two side plates 20 are provided along both end edges in an axial direction of the bottom plate 22. An opening 16 is provided in an upper surface of the one side plate 20, and the two openings 16 are provided in an upper surface of the other side plate 20. Such a positional relationship is established that the openings 16 respectively correspond to the hole 8 when the reactor main body 2 is placed on the heat dissipation sheet 18.

The two heat dissipation sheets 18 are arranged on an upper surface of the bottom plate 22. A length of each heat dissipation sheet 18 in the axial direction is longer than a length of the coil 12 in the axial direction. A length of each heat dissipation sheet 18 in the orthogonal direction is longer than a length of the coil 12 in the orthogonal direction. When the reactor main body 2 is placed on the heat dissipation plate 23, the heat dissipation sheet 18 is interposed between the coil 12 and the heat dissipation plate 23.

Figure 2:
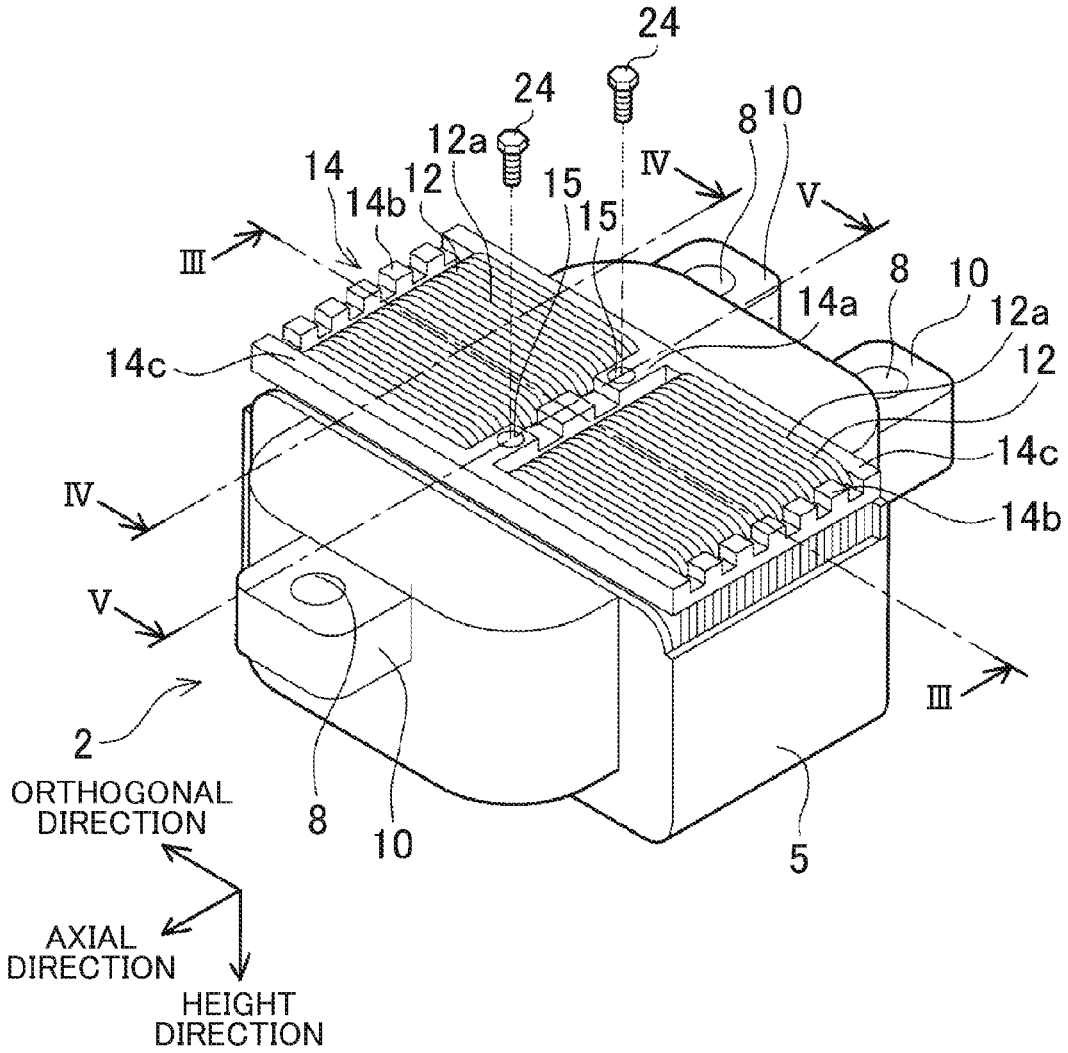
FIG. 2 is a perspective view of a bottom surface of a reactor main body in FIG. 1.

A pressing frame 14 includes a first portion 14a and second portions 14*b*, 14*c*. The first portion 14*a* is coupled to a lower surface 5*b* (see FIGS. 3, 5), and the second portions 14*b*, 14*c* are separately located from the central section 5*a* (see FIG. 3). The first portion 14*a* and the second portion 14*b* are along the axial direction, and the second portion 14*c* is along the orthogonal direction. Two holes 15 are provided in the first portion 14*a*. As shown in FIG. 2, the pressing frame 14 is coupled and fixed to the central section 5*a* when a screw 24 is screwed into each hole 15. Meanwhile, as shown in FIGS. 3, 4, the second portions 14*b*, 14*c* are not in contact with the resin cover 5 and can be displaced in the vertical direction with respect to the resin cover 5 other than the central section 5*a*.

In a state where the pressing frame 14 is coupled to the lower surface 5*b*, as shown in FIG. 1, when the screw 4 is screwed into each opening 16 from each hole 8, the reactor main body 2 is attached to the heat dissipation plate 23 with the heat dissipation sheet 18 being interposed therebetween. The bottom surfaces 12*a* (see FIG. 2) of the coils 12 that are projected from the resin cover 5 are respectively and tightly adhered to the heat dissipation sheets 18 while respectively crushing the heat dissipation sheet 18. Heat generated in the reactor main body 2 is dissipated to the heat dissipation plate 23 via the heat dissipation sheet 18.

In the central section 5*a* (see FIG. 3) of the resin cover 5, the heat dissipation sheet 18 is crushed by the coupled first portion 14*a* of the pressing frame 14. Meanwhile, in portions other than the central section 5*a* of the resin cover 5, the heat dissipation sheet 18 is crushed by the second portions 14*b*, 14*c* of the pressing frame 14 that can be displaced in the vertical direction with respect to both of the coil 12 and the resin cover 5. According to this structure, a fixing force during fixation of the reactor main body 2 to the heat dissipation plate 23 can relatively be small due to reasons that an abutment surface between the pressing frame 14 and the heat dissipation sheet 18 is limited, that the pressing frame 14 is elastically deformed and crushes the heat dissipation sheet 18, and the like. The bottom surface 12*a* of the coil 12 is tightly adhered to the heat dissipation sheet 18 without clearance with the relatively small fixing force. Thus, thermal resistance between the coil 12 and the heat dissipation sheet 18 can be suppressed to be low. That is, work for attaching the reactor main body 2 to the heat dissipation plate 23 can be facilitated.

In a state where the pressing frame 14 is coupled to the lower surface 5*b*, the second portions 14*b*, 14*c* are not in contact with the resin cover 5 (see FIGS. 3, 4). That is, because the second portions 14*b*, 14*c* are not pressed by the resin cover 5, the second portions 14*b*, 14*c* are in such a state of being more likely to be elastically deformed. As a result, the required fixing force can further be reduced.

In the first portion 14*a* and the second portion 14*b*, surfaces that oppose the heat dissipation sheet 18 are formed with irregularities. In this way, an area in which the pressing frame 14 and the heat dissipation sheet 18 contact each other is reduced. That is, an area of a portion in which the pressing frame 14 receives the reactive force is reduced. Thus, the work for attaching the reactor main body 2 to the heat dissipation plate 23 can further be facilitated.

In the example, the pressing frame 14 is coupled to the lower surface 5*b* by the screw 24. However, instead of this, the pressing frame 14 may be coupled to the lower surface 5*b* by an adhesive, for example. That is, means for coupling the pressing frame 14 to the lower surface 5*b* is not limited in any case.

The two heat dissipation sheets 18 in the example may be coupled and constructed as the single heat dissipation sheet.

In a reactor that is disclosed in this specification, a bottom surface of a reactor main body is pressed against an upper surface of a cooler via a heat dissipation sheet. The reactor main body includes paired coils that are arranged in parallel, and bottom surfaces of the coils that come in contact with the heat dissipation sheets are aligned in the same plane. Portions of the coil other than the vicinity of the bottom surface are covered with a resin cover. The resin cover covers a side surface and an upper surface of each coil and is formed with a central section that extends between the paired coils and covers the side surface of each coil. In the reactor that is disclosed in this specification, a pressing frame that extends along an outer periphery of the bottom surface of each coil and presses the heat dissipation sheet toward the cooler is provided. While the pressing frame is coupled to a lower surface of the central section of the resin cover, in positions other than that, the pressing frame can be displaced in a vertical direction with respect to the resin cover.

According to the above configuration, in portions other than the central section of the resin cover, the heat dissipation sheet is crushed by the pressing frame that extends along the outer periphery of the bottom surface of each coil and can be displaced in the vertical direction with respect to both of the coils and the resin cover. According to this structure, a fixing force during fixation of the reactor main body to the cooler can relatively be small due to reasons that an abutment surface between the pressing frame and the heat dissipation sheet is limited, that the pressing frame is elastically deformed and crushes the heat dissipation sheet, and the like. The bottom surface of the coil is tightly adhered to the heat dissipation sheet without clearance with the relatively small fixing force. Thus, thermal resistance between the coil and the cooler can be suppressed to be low.

It should be noted that, in a state where the reactor main body is attached to the cooler, the portions of the pressing frame other than the central section may not be in contact with the resin cover.

The specified example of the invention has been described in detail so far. However, this is merely illustrative and does not limit the scope of the claims. In the technique described in the scope of the claims, various modifications and changes that are made to the above exemplified specific example are included. In addition, technical elements described in this specification or the drawings exert technical usefulness only by itself or by various combinations, and thus are not limited to the combinations described in the claims upon the filing. Furthermore, the techniques exemplified in this specification or the drawings simultaneously achieve plural purposes and exert the technical usefulness by achieving one of the purposes.

What is claimed is:

1. A reactor cooled by a cooler, the reactor comprising:

a heat dissipation sheet; and a main body including:

a first coil and a second coil arranged in parallel to each other, a first bottom surface as a bottom surface of the first coil and a second bottom surface as a bottom surface of the second coil being aligned in a same plane, and the first bottom surface and the second bottom surface being configured to be pressed against an upper surface of the cooler via the heat dissipation sheet;

a resin cover that covers side surfaces and upper surfaces of the first coil and the second coil other than vicinity of the first bottom surface and the second bottom surface, the resin cover having a central section that covers the side surfaces of the first coil and the second coil between the first coil and the second coil; and a pressing frame extending along outer peripheries of the first bottom surface and the second bottom surface, the pressing frame being configured to press the heat dissipation sheet toward the cooler, the pressing frame having a coupled section, the coupled section being coupled to a lower surface of the central section, and the pressing frame being able to be displaced in a vertical direction with respect to the resin cover other than the central section.

2. The reactor according to claim 1, wherein the pressing frame that is separately located from the central section is not in contact with the resin cover.

3. The reactor according to claim 1, wherein the first bottom surface and the second bottom surface are in contact with the heat dissipation sheet.

4. The reactor according to claim 1, wherein the pressing frame has such a shape that a first square for surrounding a first opening and a second square for surrounding a second opening share one side with each other, the coupled section is arranged on a shared one side of the pressing frame.

* * * * *